US008444390B2

(12) United States Patent
Read

(10) Patent No.: US 8,444,390 B2
(45) Date of Patent: May 21, 2013

(54) HOLLOW TURBINE BLADE

(75) Inventor: Simon Read, Derby (GB)

(73) Assignee: Rolls-Royce PLC, London (GB)

( * ) Notice: Subject to any disclaimer, the term of this patent is extended or adjusted under 35 U.S.C. 154(b) by 496 days.

(21) Appl. No.: 12/870,115

(22) Filed: Aug. 27, 2010

(65) Prior Publication Data

US 2011/0081249 A1 Apr. 7, 2011

(30) Foreign Application Priority Data

Oct. 2, 2009 (GB) ..... 0917229.7

(51) Int. Cl.
*F01D 5/18* (2006.01)

(52) U.S. Cl.
USPC ..... 416/229 A; 416/233

(58) Field of Classification Search
USPC ..... 416/229 R, 229 A, 233, 226; 228/157; 29/889.72
See application file for complete search history.

(56) References Cited

U.S. PATENT DOCUMENTS 4,811,890 A 3/1989 Dowling et al.
4,882,823 A * 11/1989 Weisert et al. ..... 29/6.1
5,240,376 A 8/1993 Velicki
5,439,354 A * 8/1995 Hansen et al. ..... 416/233
5,513,791 A * 5/1996 Rowe et al. ..... 228/118
5,581,882 A 12/1996 Fowler et al.
6,039,542 A * 3/2000 Schilling et al. ..... 416/233
6,979,180 B2 * 12/2005 Motherwell ..... 416/229 R
7,431,197 B2 * 10/2008 Franchet et al. ..... 228/193

FOREIGN PATENT DOCUMENTS

GB 2 269 555 A 2/1994
GB 2 450 935 A 1/2009
WO WO 95/29787 11/1995

OTHER PUBLICATIONS

Great Britain Search Report dated Oct. 22, 2009 in Great Britain Patent Application No. 0917229.7.

* cited by examiner

*Primary Examiner* — Edward Look
*Assistant Examiner* — William Grigos
(74) *Attorney, Agent, or Firm* — Oliff & Berridge, PLC

(57) ABSTRACT

A blade for a turbine engine made by the diffusion-bonding/superplastic-forming (DB/SPF) process has a hollow skin made of front and back panels 1, 3 and internal reinforcement in the form of webs 5 extending between the two faces or panels at an angle to the plane of the blade. The cavities are filled with viscoelastic damping filler 7. In order to allow the blade to deform more easily so that the filler can take up the strain, the webs are pre-buckled so as to compress at least some of the webs. When the blade is deformed, the webs straighten or buckle further, applying a deformation to the filler as they do so and thus dissipating energy. The blade is thus well reinforced against impact but still capable of damping vibrations.

9 Claims, 3 Drawing Sheets

HOLLOW TURBINE BLADE

The invention relates in particular to blades for turbine engines, though it may be used for other components that need to be lightweight but also capable of taking up considerable static and dynamic loads.

Metal blades for larger engines tend to be hollow, to reduce weight and materials costs. The cavity is filled with a viscoelastic polymer to damp vibrations in the blade. While the strength of such a blade is adequate for the stresses arising in operation, for additional resistance to impact of foreign objects such as birds some reinforcement is necessary.

A successful design for strengthening such blades is the diffusion-bonded superplastic-formed (DB/SPF) technique. In this method, two panels forming the outer skin of the blade are placed one on top of the other with a patterned sheet between them that defines the bonding points or lines; these lines generally run longitudinally, perhaps 30 of them in a blade of width 40 cm. The assembly is then heated to bond the panels at these desired locations and inflated to form a blade shape. The blade is usually twisted at the same time. At the high temperatures used, the bonded parts pull material from both panels as the structure expands, to form the reinforcing webs; the webs stretch between the panels at an angle of about 45° (to the blade thickness direction). This process is widely used and is described, for instance, in Rolls-Royce's earlier applications GB 2269555 and GB 2306353 and in UTC's WO 95/29787.

Such a blade is also known as a linecore blade. The structural reinforcement is in the form of elongate webs running the length of the blade, the webs being alternately inclined to the blade thickness direction so as to form a kind of corrugation. This is illustrated in U.S. Pat. No. 5,581,882 (Fowler et al, Rolls Royce) and U.S. Pat. No. 5,240,376 (McDonnell Douglas).

A disadvantage of the SPF/DB technique is that the blade, as well as being stronger, is also more rigid. This means that, if the cavity or cavities are then filled with damping material, the damping effect is largely lost because the blade will not flex enough for a given stress. There exist various methods of reinforcing damping materials so that they better withstand other structural loads. However, such methods also tend to reduce strain in the damping medium and therefore reduce or negate the damping effect. The invention aims to tackle this problem.

This invention can use a similar construction to a conventional linecore but makes modifications to the structure; manufacturing methods are also contemplated. According to one aspect of the invention there is provided a blade for a turbine engine, the blade having a hollow skin and internal reinforcement in the form of webs extending between the two faces of the skin at an inclination to the plane of the blade, in which at least some of the webs are buckled, in the rest stage of the blade, so as to be capable of extension upon deformation of the blade. Preferably at least part of the remaining space is occupied with a visco-elastic filler, so that when an adjacent web straightens or extends, or indeed is further buckled or compressed, work is done on the filler to damp movement. Preferably all the webs are buckled, so that the blade can deform at a low modulus in any direction.

In a second aspect the invention provides a method for making such a blade, in which a skin formed of two overlaid panels is inflated, forming webs between the panels by virtue of local bonding, and the pressure is then released or the panels are compressed or displaced with respect to each other so as to buckle at least some of the webs.

The invention is preferably applied to a hollow DB/SPF fan blade. Typically such blades are made of titanium alloys, and the forming/bonding process is done at 800-900° C.

The webs preferably extend largely longitudinally along the blade, from root to tip. They can all be buckled in the same direction across the width of the blade, or in alternate directions, or randomly. The buckling should be at least 0.5 mm or so off the plane; for a typical blade thickness of a few centimeters the thickness will normally decrease from perhaps 40-50 mm at the root to 10-15 mm at the tip.

The efficiency of a strain-based damper is dependent on the strain energy in the damping material relative to the total strain energy in the structure; consequently, damping can be maximised if the strain in the damping material is maximised.

For a better understanding of the invention, embodiments of it will now be described, by way of example, with reference to the accompanying drawings, in which.

Figure 4A:
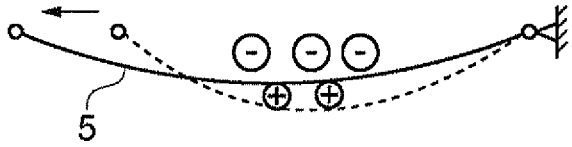
Figure 4B:
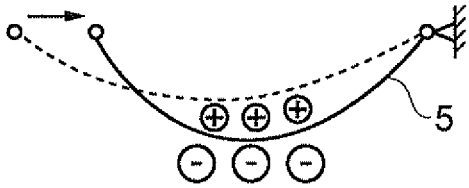

FIG. 3 diagrammatically shows various stages in the function of the blade;

FIG. 4 shows how the movement of the web amplifies the damping effects; and

Figure 5:
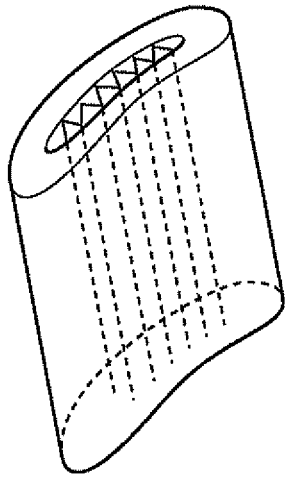

FIG. 5 shows a blade to which the invention can be applied.

Figure 1:
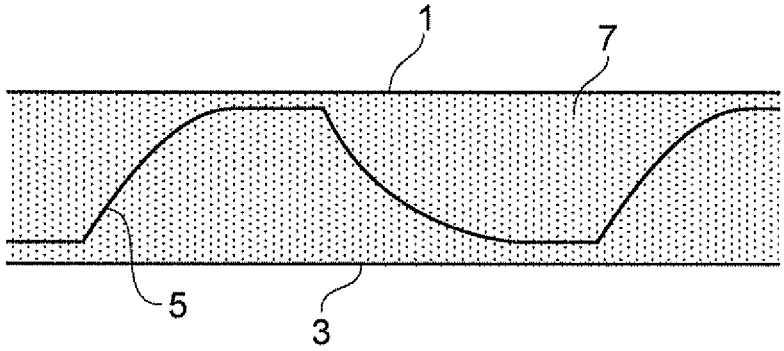
FIG. 1 shows a section through an embodiment at rest, showing the buckling.

FIG. 1 schematically shows a section through a fan blade, having an outer skin made of two panels, a pressure side panel 1 and a suction side panel 3. Generally longitudinal reinforcement webs or membranes 5 extend between the panels in the manner of a corrugation. The section is across the blade, showing the webs inclined at an angle of about 45° to the thickness of the blade. The blade is made by the SPF/DB process, the webs being formed as the blade is inflated at a high temperature at which the metal is easily deformable and quite viscous. The modification envisaged by the invention is to pre-buckle the web of the core structure so that the webs 5 are not flat (planar) but somewhat curved. This is achieved by deforming, preferably compressing, the blade after inflation, as will be described. Hence the webs 5 are not quite flat, as in the prior art, but deformed by maybe 1-5% from the plane—say, 0.5 mm for a chord of 40-50 mm.

Thus when a load is applied to the blade at low strain rates (either radial bending or torsion around the stacking axis during vibration), the webs deform laterally (elastic buckling) and strain the visco-elastic material local to the web.

Figure 2:
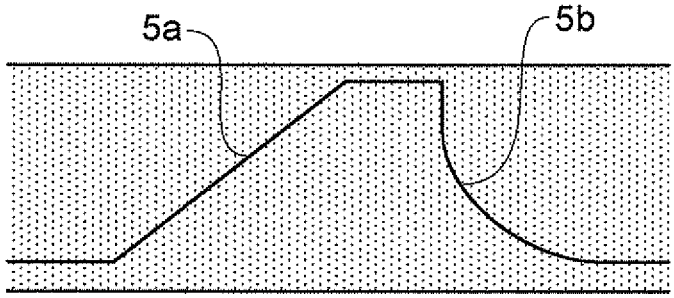
FIG. 2 shows a second embodiment.
Figure 3A:
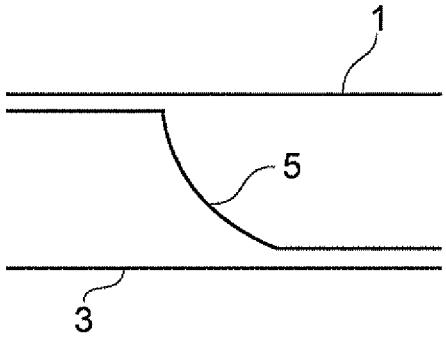
Figure 3B:
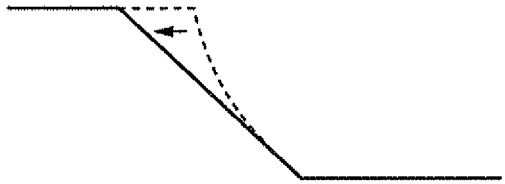
Figure 3C:
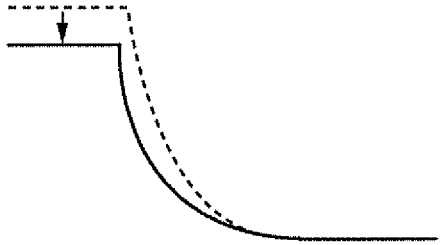
Figure 3D:
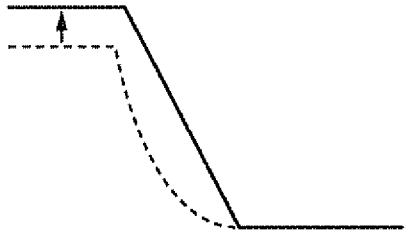

FIG. 2 shows a different embodiment in which the two panels 1, 3 are deformed by displacement in the plane. One web 5*a* is now taut (flat), so that the damping is less effective for displacements in the same direction as the deformation, but the other 5*b* is buckled, and so there is good damping at least for reverse displacements.

The principle of strain amplification is illustrated in. FIG. 3. This straining effect is in addition to any strain that might occur due to compression or shear of one panel relative to the other; consequently the strain energy in the damping filler (7) is maximised. FIG. 3(*a*) shows the same section as FIGS. 1 and 2, with the blade undeformed. FIG. 3(*b*) (which shows only the web 5, for ease of understanding) shows a shear load of the upper panel 1 to the left; the web 5 straightens. FIG. 3(*c*) shows compressive load on the blade, causing the web to buckle further, and FIG. 3(*d*) a tensile load, again straightening the web.

FIGS. 4(*a*) and 4(*b*) show how the movement of the web 5 in straightening (4*a*) or further buckling (4*b*) applies a force to the filler on both faces of the web, amplifying the damping effect. Minus signs indicate tensile strain, plus signs indicate compressive strain.

During impact, the load-carrying capability is not compromised since shear loadings (due to relative motion of the panels) are taken by the tensile members. The compressive members will tend not to buckle, because of micro-inertial structural effects and also the significant strain-rate strengthening of the viscoelastic filler (a characteristic of polymer materials).

Any type of viscoelastic damping medium is suitable, e.g. epoxy, polyurethane, etc. or a syntactic mixture (incorporating glass, polymer, ceramic, metallic, etc. solid or hollow microspheres).

The pre-buckled linecore can be manufactured by using a similar process to the current SPF/DB linecore blade manufacturing route. The key difference here is to over-blow the blade to something over the nominal blade thickness and then compress the panels, as shown in FIG. 1. The compression could be performed in a second mould, for instance.

Alternatively, twisting the blade or shearing the panels relative to one another will result in tensile members remaining straight and compressive members becoming buckled, as in FIG. 2.

The structure allows the blade to deform before the reinforcing membranes are taut, which maximises the strain passed into the viscoelastic filler material; the damping is thus maximised without compromising the other structural and integrity requirements.

The invention thus describes use of the buckling behaviour of a compressive member to amplify the strain passed into a strain-based damping medium where a structure is in place to provide through-thickness reinforcement.

The invention claimed is:

1. A blade for a machine such as a turbine engine, the blade having a hollow skin formed from two panels and internal reinforcement in the form of webs extending between the two panels so as to reinforce the blade, in which at least some of the webs are configured in a buckled state so as to be capable of extension upon deformation of the blade.

2. A blade according to claim 1, in which the remaining space between the webs is occupied with a visco-elastic filler.

3. A blade according to claim 1, in which the webs extend longitudinally with respect to the blade.

4. A blade according to claim 1, in which the buckling is about 1-5% out of the plane of the webs.

5. A blade according to claim 1, in which the blade is made of a titanium alloy.

6. A turbine engine having turbine blades according to claim 1.

7. A method for making a hollow blade, in which an initial empty skin made of two panels attached to each other at selected points is inflated, forming webs extending at an angle to the thickness of the blade, and the panels are then displaced in order to buckle the webs out of a planar shape.

8. A method according to claim 7, in which the displacement of the panels is carried out in the thickness direction by releasing the pressure at the end of the inflation process, or by separately compressing the panels after formation of the blade.

9. A method according to claim 7, in which the displacement is performed in the plane of the blade, by moving or twisting the panels with respect to each other.

* * * * *